US010112221B1

(12) United States Patent
Pedziwiatr

(10) Patent No.: US 10,112,221 B1
(45) Date of Patent: Oct. 30, 2018

(54) ULTRASONIC PROCESSING APPARATUS AND METHOD

(71) Applicant: Michael P. Pedziwiatr, Greenwood Lake, NY (US)

(72) Inventor: Michael P. Pedziwiatr, Greenwood Lake, NY (US)

( * ) Notice: Subject to any disclaimer, the term of this patent is extended or adjusted under 35 U.S.C. 154(b) by 407 days.

(21) Appl. No.: 14/749,872

(22) Filed: Jun. 25, 2015

Related U.S. Application Data

(60) Provisional application No. 62/021,791, filed on Jul. 8, 2014.

(51) Int. Cl.
*B08B 3/00* (2006.01)
*B08B 7/00* (2006.01)
*B08B 3/04* (2006.01)

(52) U.S. Cl.
CPC ..... *B08B 3/045* (2013.01); *B08B 3/041* (2013.01)

(58) Field of Classification Search
CPC ..... B08B 3/12; B08B 3/041; B08B 3/045
See application file for complete search history.

(56) References Cited

U.S. PATENT DOCUMENTS 3,002,731 A 10/1961 Gelfand et al.
3,222,221 A 12/1965 Branson
4,475,259 A 10/1984 Ishii et al.
4,812,211 A * 3/1989 Sakai ..... C25D 13/22 118/425
5,012,918 A * 5/1991 Acker ..... B65G 47/61 104/127
5,113,882 A 5/1992 Gileta
5,333,628 A 8/1994 Ogata et al.
5,439,015 A * 8/1995 Shibano ..... B08B 3/12 134/66
5,667,057 A 9/1997 Randall et al.
5,823,210 A 10/1998 Inada et al.
5,950,643 A * 9/1999 Miyazaki ..... B28D 5/0076 134/201
6,006,439 A * 12/1999 Del Mercado ..... H01M 2/28 134/61
6,125,862 A 10/2000 Ishikawa et al.
6,253,907 B1 * 7/2001 Lachmann ..... B65G 49/0445 198/465.4
6,345,635 B2 * 2/2002 Lachmann ..... B65G 49/0445 134/76

(Continued)

*Primary Examiner* — Alexander Markoff
(74) *Attorney, Agent, or Firm* — Arthur Jacob

(57) ABSTRACT

Apparatus and method utilize an ultrasonic operation to process articles. Processing tanks are arranged serially, each having an interior extending vertically downwardly for receiving articles delivered into the tank. A plurality of baskets carry the articles to the consecutive tanks, and an overhead support arrangement at each tank receives each basket suspended from a corresponding support placed at a first location outside and above the tank. Each support is moved in a vertical direction between the first location, outside the tank, wherein the support is in position to receive a corresponding basket suspended below the support, and a second location outside the tank and below the first location, wherein the corresponding basket is placed within the tank, while the support remains outside the tank, whereby the articles are placed sequentially into each tank, while the supports remain overhead, outside the tanks, during a processing operation.

18 Claims, 7 Drawing Sheets

(56) References Cited

U.S. PATENT DOCUMENTS

| | | | | |
|---|---|---|---|---|
| 6,575,177 | B1 * | 6/2003 | Brown | B08B 1/04 134/76 |
| 2015/0328395 | A1 * | 11/2015 | Zhao | B08B 3/123 134/18 |

* cited by examiner

ULTRASONIC PROCESSING APPARATUS AND METHOD

The present invention relates generally to apparatus and method using ultrasonic operations for processing articles and pertains, more specifically, to automated systems in which a series of ultrasonic processes are carried out serially, in automatic sequence.

Typically, ultrasonic cleaning processes include three separate processes: namely, ultrasonic cleaning, where contaminants are removed from the articles being cleaned; ultrasonic or non-ultrasonic rinsing, to remove the cleaning agents employed in the cleaning process; and drying, to remove liquid, usually water, used in the rinsing process. Batches of articles are placed into respective stainless steel baskets, and each basket is lowered into corresponding tanks serially to perform a complete cleaning, rinsing, and drying operation. Where operators are not available to transfer the baskets from tank-to-tank manually, an automatic system typically is employed to perform the transfer operation.

Other processes, such as the passivation of metal articles, also include a series of tanks, some of which contain high-strength, acidic solutions, such as nitric or citric acid, which are used to passivate metals, typically stainless steel, to restore corrosion resistance. The series of tanks may include ultrasonic cleaning tanks initially to remove from surfaces of the metal articles all contaminants that could interfere with passivation, rinse tanks to remove cleaning agents, passivation tanks to passivate the metal articles, additional rinsing tanks to remove the passivation fluids, and drying tanks to remove the final rinse liquid, typically water.

In order to accomplish the above-outlined procedures, a series of processing tanks is employed, usually comprising: one or two tanks to perform the ultrasonic cleaning; one to three tanks to perform the rinsing; and one to three drying tanks, or a multi-position drying tunnel, to perform the drying operation. Articles must be transferred from tank to tank, either manually, or by an automated system.

Current automated system designs are available in essentially two different variations. The first is an overhead gantry-type automated system which engages a basket from above, lifts the basket from a given tank, moves the basket to the next processing tank in the series, releases the basket, and then moves away to move other baskets of articles, as required. There are many shortcomings connected with this particular system design. Since each basket must be positioned within a corresponding tank with precision in order to ensure that the pick-up device properly engages the basket, these systems typically require a specialized positioning platform to position the basket at the precise location for engagement with the transfer mechanism. This is especially important when ultrasonic systems are present in the tank since ultrasonic vibrations can move the basket out of position and therefore out of registration with the pick-up device. Such an event can cause a catastrophic spill of articles being processed, which, in most cases, can result in a very large increase in the cost of manufacture, sometimes amounting to thousands of dollars, depending upon the value of the damaged articles, as well as the disruption in the manufacturing process itself. Moreover, the need for a "basket rest" within the tank results in a distortion of and a reduction in the amount of ultrasonic energy available to clean and/or rinse the articles being processed where ultrasonic systems are employed to enhance such cleaning or rinsing operations. In addition, since each tank does not include an independent oscillation platform, agitation of the articles being processed, to promote the process, can take place only after the basket has been engaged with the transfer device, typically just before the basket is transferred to the next adjacent tank, so that any oscillation, and concomitant agitation of the articles, is limited to the short time just before transfer. This automated system design is the most common type currently available for ultrasonic cleaning processes.

Another type of automation, such as that disclosed in U.S. Pat. No. 5,667,057, adds an oscillating platform to each "machine", and a "push bar" assembly which pushes each basket to be transferred from the oscillating platform of one machine onto the oscillating platform of the next machine along a guided path. This arrangement has several advantages. Since an oscillating platform is included in each tank, baskets of parts to be cleaned can be either intermittently or continuously oscillated within the cleaning, rinsing, and drying processing tanks. This provides a more evenly-distributed cleaning and rinsing effect on the product being cleaned since the product is subjected to "standing waves" of energy generated by the ultrasonic systems, creating turbulence which aids in the removal of contaminants trapped within certain contours of the product, such as blind holes and other detailed features.

However, there are inherent problems with the system disclosed in the aforesaid U.S. Pat. No. 5,667,057 with respect to optimizing ultrasonic cleaning or rinsing. Since each basket is supported by a complex support structure placed beneath the basket, a number of structural components comprised of metal and plastic are submerged, along with the basket, within the ultrasonic bath, all of which components can distort and absorb energy being generated by the ultrasonic systems, thereby drastically reducing effective ultrasonic power and, concomitantly, the effectiveness of the cleaning and rinsing processes. This becomes even more evident with the processing of a heavy load of parts in a basket, since the support structure must be manufactured of thicker materials, which materials will absorb and distort the ultrasonic energy to an even larger degree. Thus, while gaining some advantage by oscillating the product being processed, the amount of ultrasonic power available to clean and rinse parts is reduced substantially. In addition, the parts are not oscillated through the surface of the bath, but rather solely beneath the surface, thus limiting the effectiveness of the oscillating action.

It is an object of the present invention to eliminate all losses and distortion of ultrasonic energy by supporting each basket from above rather than from beneath the basket, using a push-bar transfer arrangement between adjacent tanks. Another object is to eliminate damage to metalwork which eventually can occur when processing products in alternative processes such as in passivation applications. In the present apparatus and method, nothing other than the basket and the articles contained within the basket are submerged in the ultrasonic cleaning baths, ultrasonic rinsing baths, or in baths of other process fluids which might attack structural materials. Articles in a basket are transferred from an overhead oscillation platform associated with one tank, to an overhead oscillation platform associated with the next consecutive tank, after which the basket is lowered to begin processing. This arrangement offers beneficial results in any process where the submersion of additional metal into a bath, other than the batch of articles being processed and the baskets themselves, could reduce the effectiveness of the process or could waste processing fluids. Once a basket is lowered into a processing tank, the corresponding ultrasonic system is activated. Since nothing other than the basket and parts contained within the basket are submerged, there is no significant absorption or distortion of the ultrasonic energy, and loss or distortion is minimized to gain maximum performance of the ultrasonic system while simultaneously providing a beneficial intermittent or continuous oscillation and concomitant agitation of the parts in the basket. Where other processes are conducted, such as passivation, no structural material is submerged in the fluid within a tank, thereby eliminating any eventual damage and destruction to the component parts of the apparatus. In addition, the entire automated system is constructed as a single apparatus, rather than as a plurality of machines, as disclosed in the aforesaid U.S. Pat. No. 5,667,057, to assure that the tanks of the system are precisely aligned for an accurate and reliable transfer of baskets.

In an automated system as described above, baskets must be constructed with supports at specific locations to allow the baskets to be transferred from overhead platform to overhead platform without the need for added supports between adjacent tanks. These supports are never submerged, and therefore will not contribute to ultrasonic energy distortion or absorption, or be affected by passivation or by other damaging process fluids. By virtue of a cantilevered load bearing structure, the overhead arrangement also reduces stresses placed on each basket support and enables the use of smaller structural elements, such as tubing, in the construction of the basket support structure. Moreover, since the entire support structure for each basket remains outside a corresponding tank during the conduct of a processing operation, the support structure can be constructed in any manner required to support a wide range of loads without affecting the intensity of the ultrasonic energy available within the tank. When baskets are supported from underneath, as disclosed in the aforesaid U.S. Pat. No. 5,667,057, each basket support is entirely submerged within a corresponding tank, with deleterious effects on the ultrasonic energy available in the tank.

The present overhead support arrangement also is more appropriate for other processes such as passivation operations which often include the use of acidic materials that may be compatible with polymeric materials, but are less compatible with metallic materials. Although tanks can be manufactured using chemically-compatible polymeric materials, the structure that supports the basket must be constructed of a higher-strength material, the most common of which, in current systems, is stainless steel. By overhanging the basket, only the basket and parts within the basket are submerged in the bath within a tank, allowing the support structure to be constructed of materials not necessarily compatible with the materials in the tank, and structurally sound enough to maintain precision in the handling of the baskets carrying the articles to be processed.

The present invention permits oscillation of each basket, and the articles carried by the basket, into and out of the bath in a corresponding tank, through the surface of the bath, a feature which is not suggested in prior systems. Current systems oscillate articles fully submerged, below the surface of a bath. Although maintaining the articles fully submerged within a bath does serve to remove contaminants from the articles, such removal often is not thorough enough. By passing the articles repeatedly through the surface of the bath, contaminants are drawn off the surface of each article, while blind holes and other contoured features are filled and drained, to remove contaminants that would not be removed by fully submerged oscillation, thereby producing a much more effective contaminant removal action. Further, oscillation of the articles through the surface of the liquid in an ultrasonic treatment bath allows the articles to pass through a high-energy wave area created by the reflection of ultrasonic energy off the underside of the surface of the liquid, thereby increasing the efficacy of the ultrasonic processing. In addition, passivation fluids are flushed into and out of critical areas of parts being processed to keep the fluids in these critical areas fresh and at maximum effectiveness.

The present invention enables tank covers to be constructed for greater effectiveness. With prior designs, sections of basket support members are submerged within the bath contained in the processing tanks, along with submersion of a basket. The addition of a tank cover which completely seals the tank is not possible since the cover must have at least one opening that allows the basket support structure to pass through the cover. With the overhead arrangement of the present invention, the tank can be completely and effectively covered since no openings for structural members are required. Such closing of a tank reduces evaporative losses during operation, and becomes even more important with passivation systems since the additional release of acidic vapors into the work environment when tanks are closed can become quite harmful. In addition, evaporative losses in passivation fluids can increase the concentration of the fluids during use, with detrimental effect on the passivation process.

The above objects and advantages, as well as further objects and advantages, are attained by the present invention, which may be summarized as apparatus for utilizing an ultrasonic operation to process articles, the apparatus comprising: a plurality of processing stations arranged serially along a processing path, each processing station including a processing tank having an interior extending vertically downwardly from an upper opening for receiving articles delivered into the interior of a corresponding processing tank through the upper opening; a plurality of article holders for carrying the articles along the processing path from one processing station to a next-consecutive processing station; and an overhead support arrangement located at each processing station for receiving each one of the article holders, in sequence, with each article holder suspended from a corresponding support placed at a first location outside the interior of a corresponding processing tank, vertically above the upper opening of the corresponding processing tank; each support being selectively movable in a vertical direction between the first location outside the interior of the corresponding processing tank, wherein the support is in position to receive a corresponding article holder suspended below the support, and a second location outside the interior of the corresponding processing tank and below the first location, wherein the corresponding article holder is placed within the interior of the corresponding processing tank, while the support remains outside the interior of the corresponding processing tank; whereby the articles are placed sequentially into the interior of each processing tank, while each support remains overhead, outside the interior of each processing tank, during a processing operation.

In addition, the present invention provides a method for utilizing an ultrasonic operation to process articles, the method comprising: arranging a plurality of processing stations serially along a processing path, with each processing station including a processing tank having an interior extending vertically downwardly from an upper opening for receiving articles delivered into the interior of a corresponding processing tank through the upper opening; carrying the articles along the processing path, within a plurality of article holders, from one processing station to a next-consecutive processing station; providing an overhead support arrangement located at each processing station for receiving each one of the article holders, in sequence, with each article holder suspended from a corresponding support placed at a first location outside the interior of a corresponding processing tank, vertically above the upper opening of the corresponding processing tank; and selectively moving each support in a vertical direction between the first location outside the interior of the corresponding processing tank, wherein the support is in position to receive a corresponding article holder suspended below the support, and a second location outside the interior of the corresponding processing tank and below the first location, wherein the corresponding article holder is placed within the interior of the corresponding processing tank, while the support remains outside the interior of the corresponding processing tank; whereby the articles are placed sequentially into the interior of each processing tank, while each support remains overhead, outside the interior of each processing tank, during a processing operation.

The invention will be understood more fully, while still further objects and advantages will become apparent, in the following detailed description of preferred embodiments of the invention illustrated in the accompanying drawing, in which.

Figure 1:
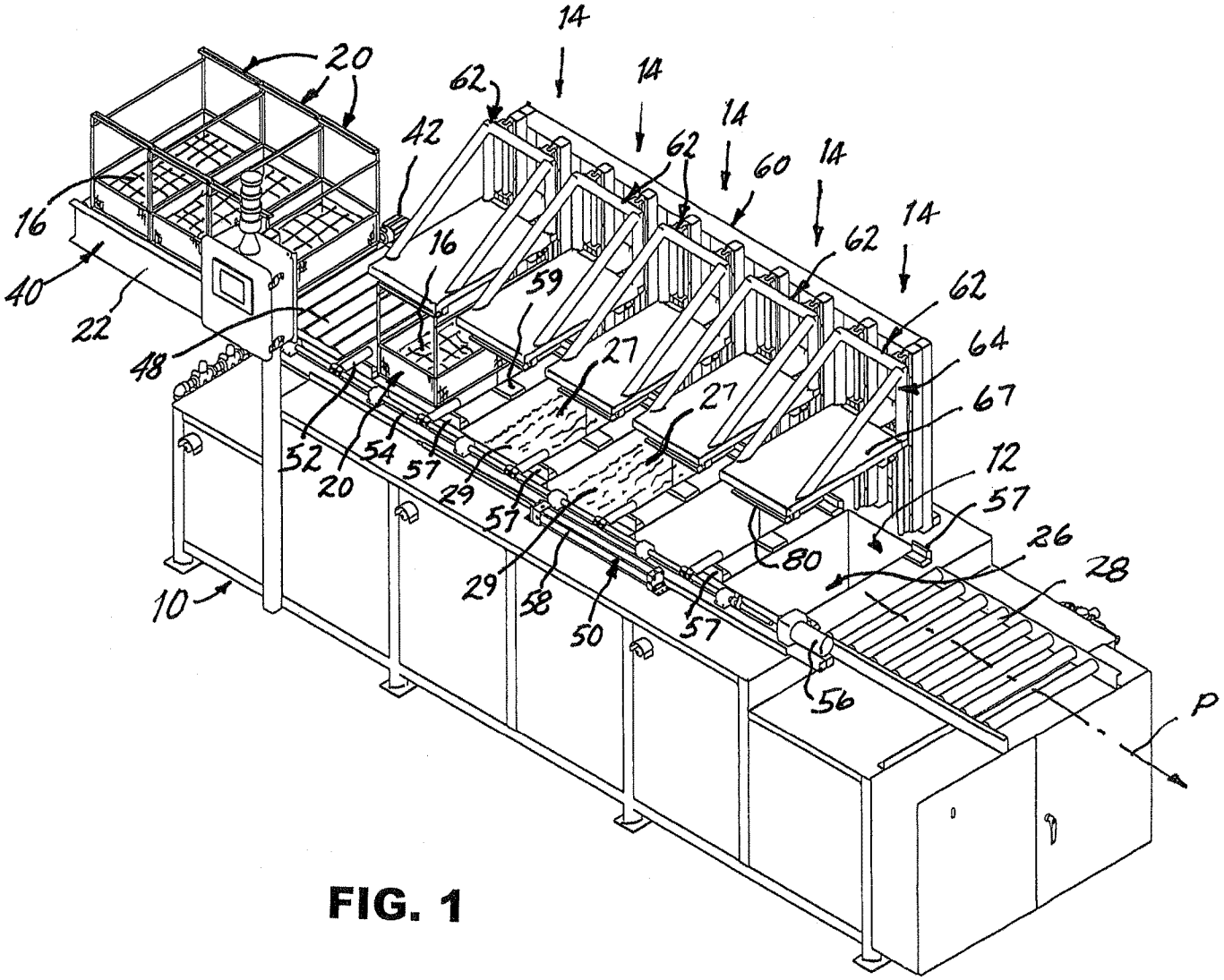
FIG. 1 is a front and right side pictorial view of an apparatus constructed and being operated in accordance with the present invention.

Referring now to the drawing, an apparatus constructed in accordance with the present invention is shown at 10 and is seen to include a plurality of processing tanks placed at serially located processing stations 14, here illustrated in the form of five tanks 12 placed in a linear arrangement along a processing path P. Apparatus 10 is constructed to accomplish the cleaning, rinsing and drying of a very wide variety of articles, such as component parts of machines and appliances, hardware items, and the like, utilizing ultrasonic energy devices and techniques to assist in the cleaning and rinsing operations. To that end, parts 16 are carried by article holders, here shown as being placed in article holders in the form of baskets 20, to be advanced initially along a load conveyor 22 to present each basket 20 for processing in each tank 12. In the illustrated apparatus and method, each basket 20 is first lowered through a top 24 into the interior 26 of tank 12-1 where the parts 16 are immersed in a bath 27 of cleaning liquid, such as a detergent, and, once immersed through the surface 29 of bath 27 to become submerged in bath 27, are subjected to ultrasonic energy, in a now well-known procedure. After an initial cleaning operation is conducted in tank 12-1, each basket 20 is lifted from tank 12-1 and advanced to tank 12-2 where, in this instance, each basket 20 is lowered to immerse and submerge the parts 16 in a second bath of cleaning liquid, and the parts 16 once again are subjected to ultrasonic energy to complete a full cleaning operation. Then each basket 20 is raised and moved along path P to tank 12-3 where each basket 20 is lowered to immerse the parts 16 in a rinsing bath, usually water, where the parts 16 are subjected, once again, to ultrasonic energy to assist in rinsing cleaning liquid from the parts 16. Upon completion of the rinsing operation, each basket 20 is lifted from tank 12-3 and transferred in sequence to tanks 12-4 and 12-5 where each basket is lowered into a drying chamber within each tank 12-4 and 12-5 for drying the parts 16, preferably by circulating heated air through the basket 20. Each basket 20 then is lifted from tank 12-5 and moved to an unload conveyor 28.

Figure 7:
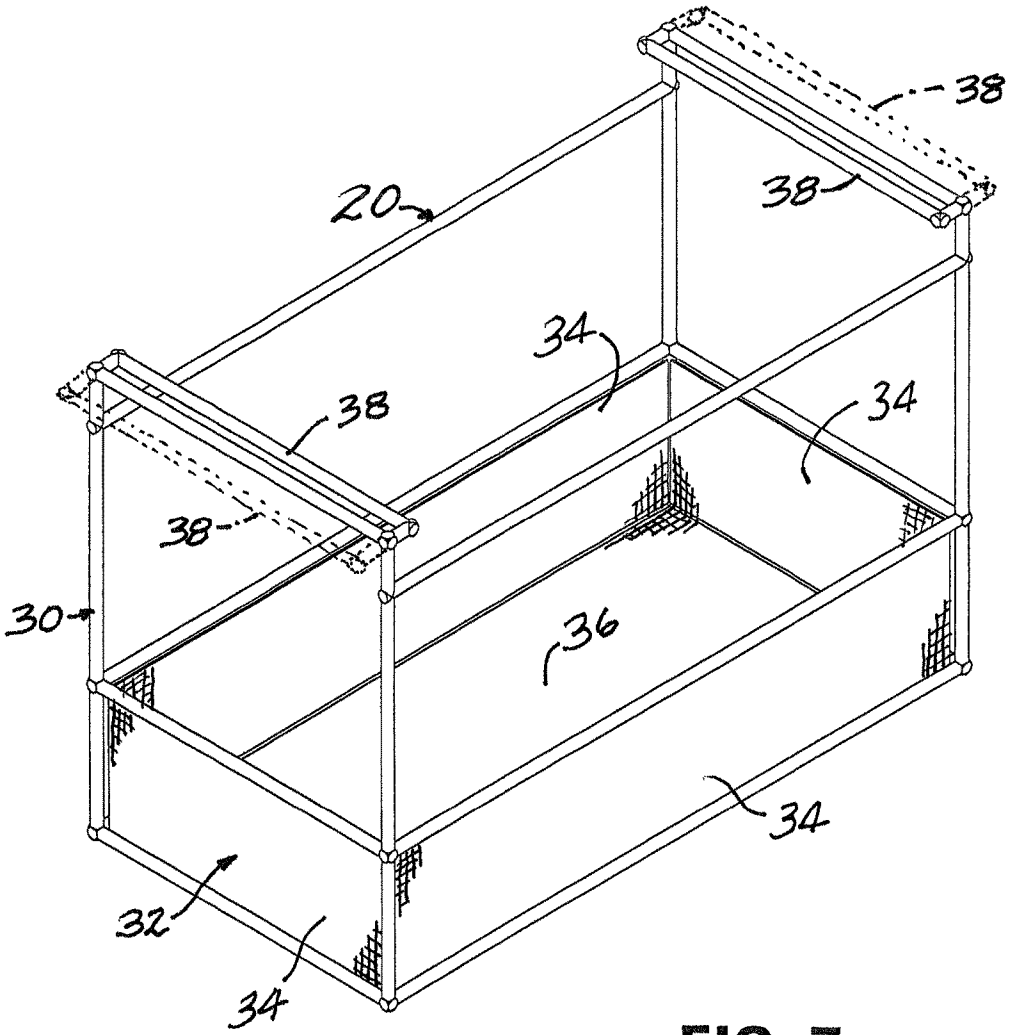
FIG. 7 is a front and side pictorial view of a component part of the apparatus.

As best seen in FIG. 7, each basket 20 includes a rigid frame 30 that carries a tray 32, having sides 34 and a bottom 36 constructed of a mesh, such as a stainless steel wire cloth, for receiving and holding parts 16 while allowing cleaning and rinsing liquids to pass through the tray 32 during cleaning and rinsing operations, and allowing the circulation of air during drying operations. In the preferred construction, the interior 26 of each tank 12 has a rectangular horizontal cross-sectional configuration, and tray 32 of each basket 20 is provided with a complementary rectangular horizontal cross-sectional configuration. Elevated above the tray 32, adjacent the top of each basket 20, at a basket engagement area, there are provided right-angle posts in the form of hook-like members 38 for suspending each basket 20 during movement of the baskets 20 through apparatus 10, as now will be described.

Figure 2:
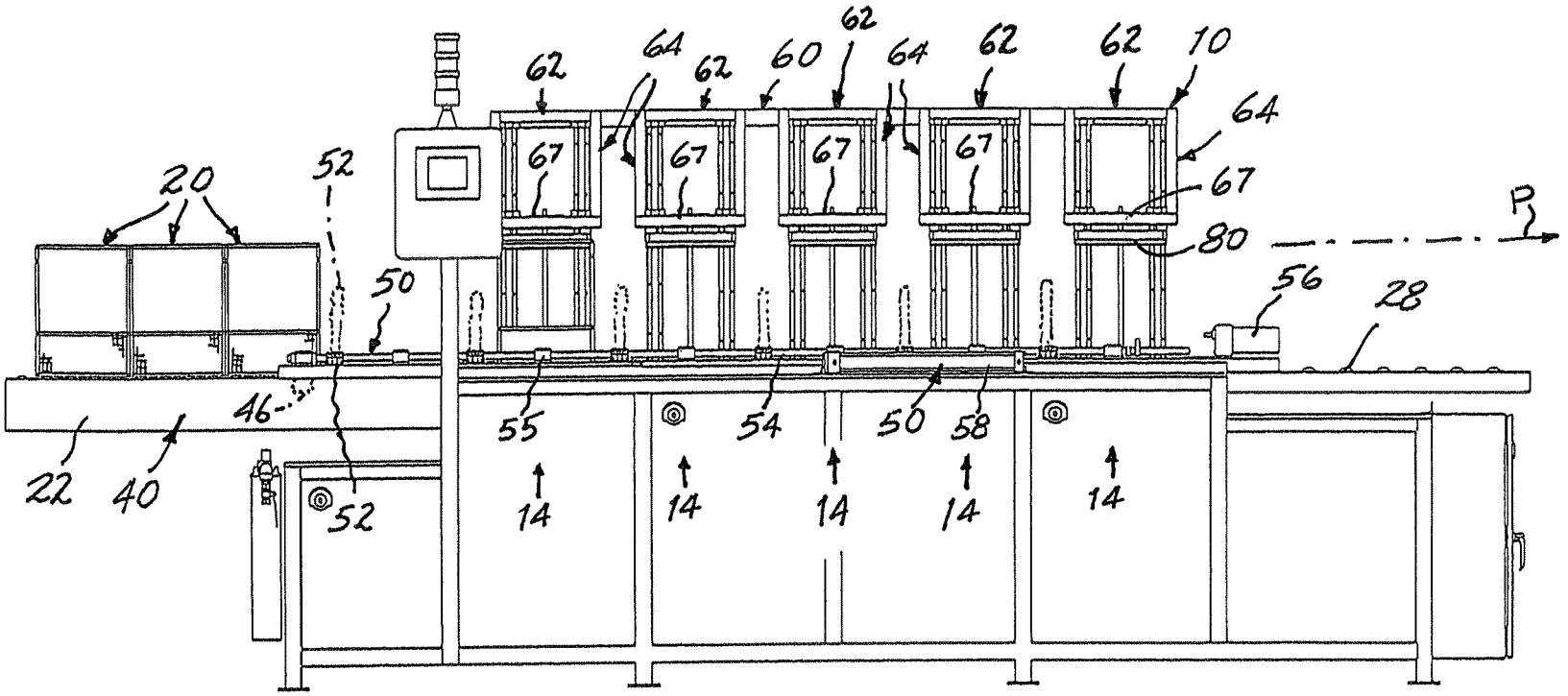
FIG. 2 is a front elevational view of the apparatus.
Figure 3:
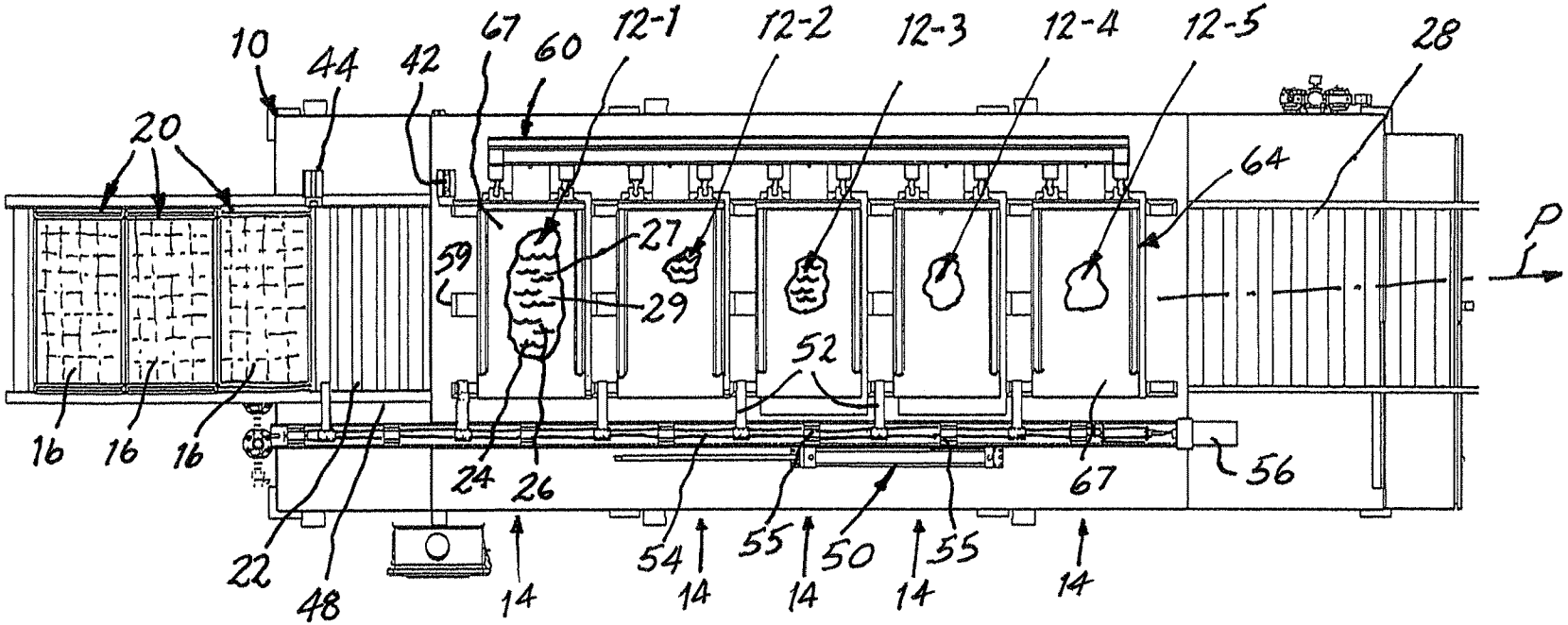
FIG. 3 is a top plan view of the apparatus.
Figure 4:
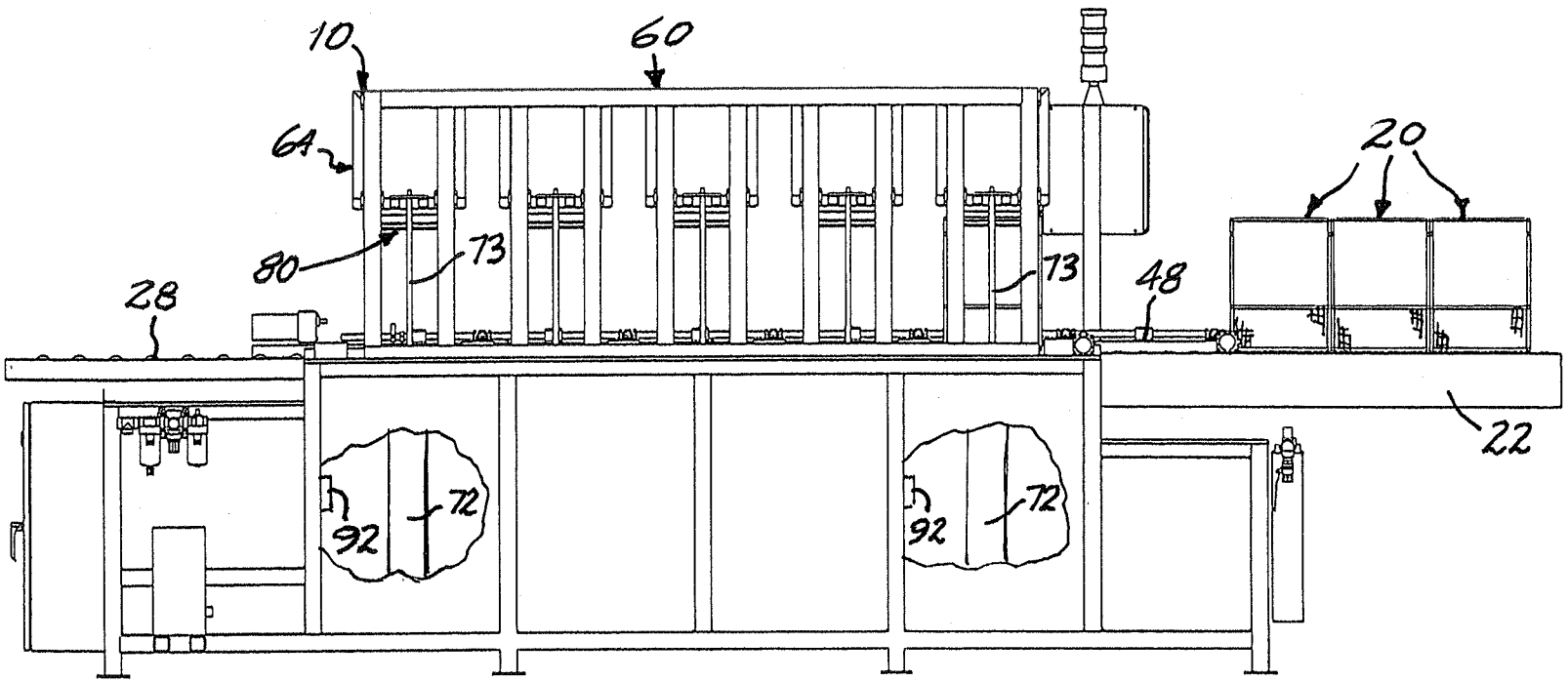
FIG. 4 is a rear elevational view of the apparatus.

Load conveyor 22 is motorized so that baskets 20 containing parts 16 are advanced along load conveyor 22 at an input station 40 where an indexing arrangement, shown best in FIG. 3, in the form of indexing piston-and-cylinder actuated stops 42 and 44, operated in sequence in response to proximity detectors in the form of proximity switches 46 mounted under load conveyor 22, accurately locates a basket 20 at a transfer position within a transfer station 48. A transfer mechanism 50 includes a plurality of transfer arms 52 which, during movement of a basket 20 into the transfer position at transfer station 48, are raised into an idle position, as illustrated in phantom in FIG. 2, to permit entry of a basket 20 into transfer station 48.

As best seen in FIGS. 1 through 3, each one of the plurality of transfer arms 52 of transfer mechanism 50 is mounted upon a transfer shaft 54 jounaled for rotation in bearings 55 which transfer shaft 54, in turn, is coupled to a rotary actuator in the foul' of a transfer motor 56 operated to rotate transfer arms 52 between the raised idle position illustrated in phantom in FIG. 2, and a lowered transfer position, shown in full lines in FIGS. 1 and 3. With the transfer arms 52 in the transfer position, between adjacent baskets 20, a transfer actuator, shown in the form of a piston-and-cylinder transfer actuator 58, is activated to move all of the transfer arms 52 and, consequently, each basket 20 along path P so as to index each basket into a position within a basket engagement and lift area, with each basket 20 accurately registered with each respective tank 12. In addition, inter-tank basket guides 57 are placed between tanks 12 to assist in stabilizing and aligning baskets 20, and further guides, in the form of guide blocks 59, are placed between tanks 12 to militate against unwanted tipping of the baskets 20, as the baskets 20 are indexed along processing path P.

A support frame 60 within the basket engagement and lift area supports a plurality of overhead basket lifts 62 spaced apart along path P such that each lift 62 is registered with a corresponding tank 12. Each lift 62 includes a carrier 64 having an L-shaped configuration comprised of a vertical slide member 66 and a support, shown in the form of a horizontal cantilever member 67 affixed to the vertical slide member 66. Each slide member 66 is coupled to a pair of vertical shafts 68 by means of slide bearings 70 which facilitate up and down oscillating movements of each basket lift 62 in vertical directions along shafts 68. A plurality of lifting actuators are shown in the form of piston-and-cylinder lift actuators 72, each mounted upon the support frame 60 and coupled to a corresponding basket lift 62 by a drive shaft 73 for selective down and up movement of each basket 20 into and out of a corresponding tank 12. In this manner, each cantilever member 67 is selectively moveable in vertical directions between the first location outside the interior 26 of a corresponding tank 12, wherein the cantilever member 67 is in position to receive a basket 20 suspended below the cantilever member 67, and a second location, wherein the suspended basket 20 is placed within the interior 26 of the corresponding tank 12, while the cantilever member 67, as well as the entire carrier 64, remains outside the interior 26 of the tank 12. In the preferred construction, carrier 64 is provided with a brace 74 extending at an angle between horizontal cantilever member 67 and vertical slide member 66 to establish a truss-like construct 76 for maintaining the cantilever member 67 in a horizontal orientation, even when under a considerably heavy load.

Figure 5:
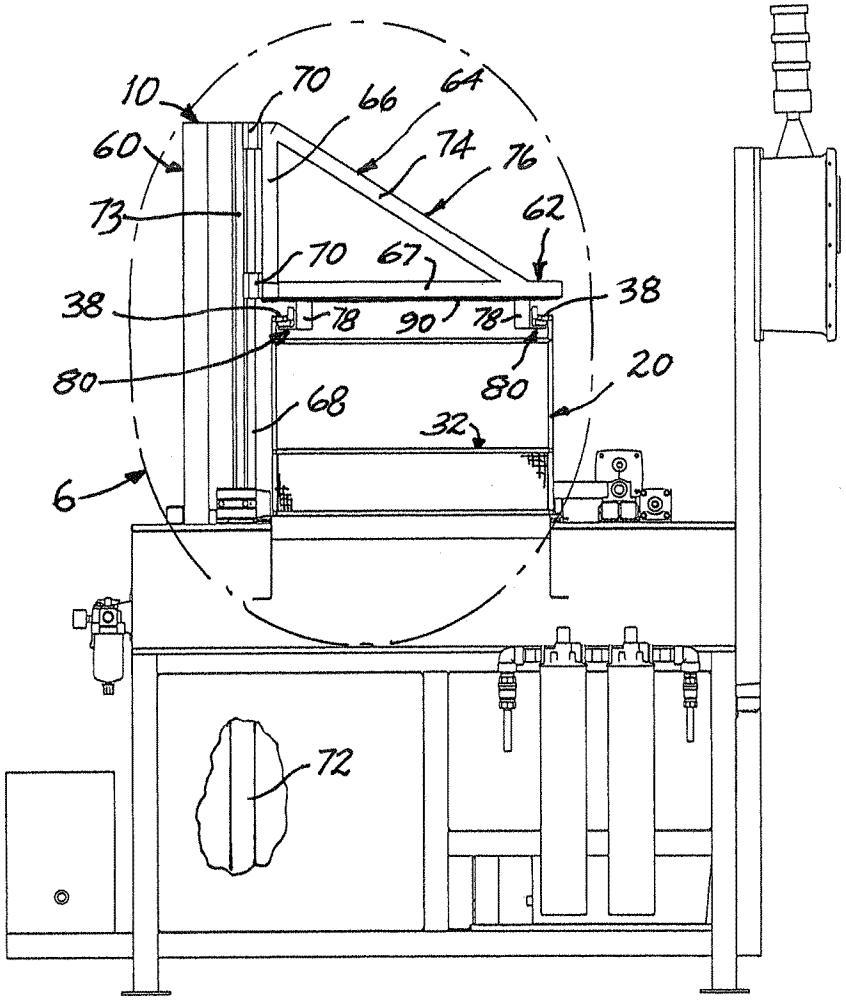
FIG. 5 is a left side elevational view of the apparatus.
Figure 6:
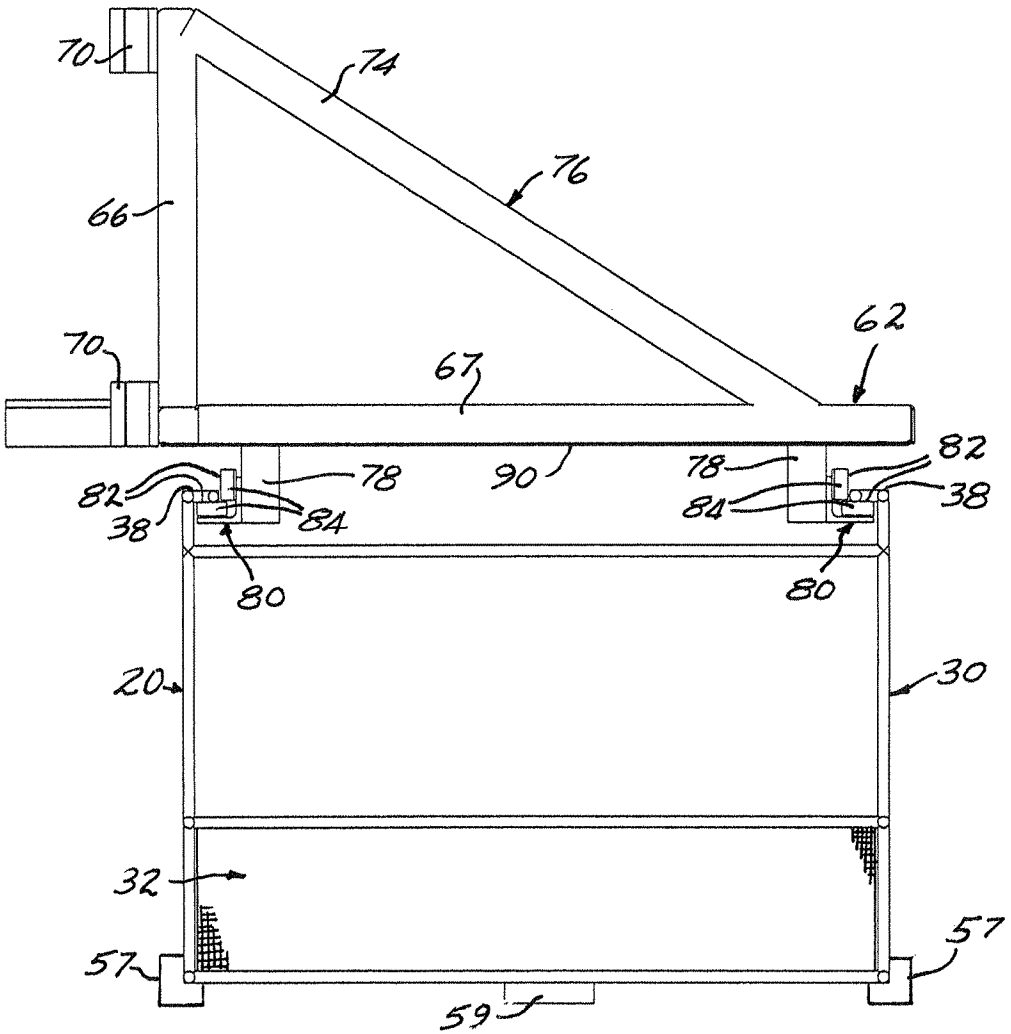
FIG. 6 is an enlarged detail of a portion of the apparatus indicated by arrow 6 in FIG. 5, with some component parts deleted for illustrative purposes.

As best seen in FIGS. 5 and 6, cantilever member 67 of carrier 64 of each basket lift 62 is coupled with each basket 20 by a coupling construct having coupling elements carried by each basket 20 and each cantilever member 67. Thus, hook-like members 38 adjacent the top of each basket 20 serve as one coupling element, while a pair of support members 78 carried by cantilever member 67 and tracks 80 located beneath the cantilever member 67 and extending in the direction of processing path P serve as a second coupling element for coupling each basket 20 with each cantilever member 67, sequentially, as follows: As each basket 20 is advanced along processing path P for registration in sequence with each tank 12, the hook-like members 38 of the basket 20 will leave the tracks 80 of one carrier 64 and engage the tracks 80 of the next-consecutive carrier 64, straddling the space between adjacent lifts 62 to maintain support of each basket 20 as the baskets 20 are indexed from tank to tank. Such engagement is facilitated by bearing surfaces 82 provided by beveled bearing members 84 which assist in placing each basket 20 in precise registration with a respective tank 12 located beneath a corresponding carrier 64. A preferred material for bearing members 84 is ultra-high molecular weight polyethylene. Once a basket 20 is so suspended from a cantilever member 67, lift actuator 72 is actuated to lower the basket 20 into the tank 12 registered beneath the cantilever member 67 for conducting a process, as outlined above.

At the same time, cantilever member 67 is fitted over the tank 12 and serves as a tank cover. As set forth above, the overhead arrangement enable any selected tank 12 to be covered and effectively sealed, thereby reducing evaporative losses during certain operations and, even more importantly, precluding the release of acidic vapors into the work environment during a passivation operation. In addition, a sealed cover enables the use of vacuum drying of cleaned and rinsed articles in an ultrasonic operation. Thus, in order to assure effective sealing of the interior 26 of a tank 12, a seal 90 may be carried by cantilever member 67 located at a corresponding station 14, as seen in FIG. 6.

It is noted that should a basket 20 be required to accommodate a very large article that may not readily be loaded into and removed from the basket 20 through the space provided between the hook-like members 38, the orientation of the hook-like members 38 may be reversed, as illustrated in phantom in FIG. 7, together with the orientation of the support members 78, which may be reversed to correspond to the orientation of hook-like members 38, thereby enlarging the access to tray 32 of the basket 20.

Since all of the structural members of the lifting arrangement, and especially carrier 64 and lift actuator 72, remain outside of each tank 12, and therefore outside of any cleaning or rinsing bath 27 contained within the interior 26 of a tank 12, during the conduct of a corresponding ultrasonic operation, the structural members of the lifting arrangement will not be in a position to affect either the intensity or the nature of ultrasonic energy generated within these baths 27. In addition, selectively movable sensors 92 are provided at each lift actuator 72 so that upon oscillation of a basket 20 within a tank 12 to promote each operation by agitation, amplitude of the stroke effecting agitation is selectively adjustable. Agitation of the parts 16 within a basket 20, during an ultrasonic process, reduces or even eliminates cavitational erosion damage to softer materials, such as aluminum, by sweeping the parts 16 through the standing waves produced by the ultrasonic system, thereby spreading the energy evenly across the surface of the material and eliminating cavitational attack of the material at the standing wave "hot-spot" locations when processed parts are stationary. Moreover, the amplitude is adjustable readily to move tray 32 of a basket 20 into and out of a bath 27, through the surface 29 of the bath 27, during agitation, to increase the effectiveness of agitation, as described above.

It will be seen that the present invention attains all of the objects and advantages set forth above.

It is to be understood that the above detailed description of preferred embodiments of the invention is presented by way of example only. Various details of design, construction and procedure may be modified without departing from the true spirit and scope of the invention, as set forth in the appended claims.

The embodiments of the invention in which an exclusive property or privilege is claimed are defined as follows:

1. Apparatus for use in processing articles sequentially, along a processing path, the apparatus comprising:

a plurality of processing stations arranged serially along the processing path, each processing station including a processing tank having an interior extending vertically downwardly from an upper opening for receiving articles delivered into the interior of a corresponding processing tank through the upper opening;

a plurality of article holders for carrying the articles along the processing path from one processing station to a next-consecutive processing station;

an indexing assembly for indexing the article holders along the processing path, from one processing station to a next-consecutive processing station;

an individual overhead support arrangement located at each processing station for receiving each one of the article holders, in sequence, with each article holder suspended from a corresponding support placed at a first location outside the interior of a corresponding processing tank, vertically above the upper opening of the corresponding processing tank; and a plurality of individual actuators, each actuator being coupled to a corresponding support for selective operation to move each support selectively in response to the selective operation of a corresponding coupled actuator, in a vertical direction between the first location outside the interior of the corresponding processing tank, wherein a selectively moved support is in position to receive a corresponding article holder suspended below the support, and a second location outside the interior of the corresponding processing tank and below the first location, wherein the corresponding article holder is placed within the interior of the corresponding processing tank, while the selectively moved support remains outside the interior of the corresponding processing tank;

whereby the articles are placed sequentially into the interior of each processing tank, while each support remains overhead, outside and vertically above the interior of each corresponding processing tank, during a processing operation; and wherein each support comprises a cantilever member extending in a horizontal orientation over a corresponding processing tank at each processing station and a support frame, each cantilever member being coupled with the support frame for selective vertical movement between the first and second locations of the support, each actuator being coupled with a corresponding cantilever member for selectively moving the corresponding cantilever member between the first and second locations.

2. The apparatus of claim 1 including coupling elements carried by each support and each article holder for uncoupling an article holder from one support and coupling the uncoupled article holder to a next-consecutive support upon indexing the article holder from the one support to the next-consecutive support.

3. The apparatus of claim 2 wherein the coupling elements comprise a track on one of the supports and the article holders, and a follower on the other of the supports and the article holders, each track and each follower being aligned with the processing path such that upon indexing an article holder, coupling elements at one processing station are disengaged, and coupling elements are engaged at the next-consecutive processing station to couple the indexed article holder in suspended coupling with the next-consecutive support.

4. The apparatus of claim 3 wherein each track is carried by a corresponding support and each follower is carried by an article holder.

5. The apparatus of claim 3 wherein each article holder comprises:

a basket for carrying the articles, each basket including a tray having a side and a bottom; and a basket frame extending vertically upwardly from the tray to a corresponding coupling element whereby each basket is suspended from a corresponding support.

6. The apparatus of claim 5 wherein the interior of each processing tank includes an essentially rectangular horizontal cross-sectional configuration, each tray includes an essentially rectangular horizontal cross-sectional configuration generally complementary to the horizontal cross-sectional configuration of each processing tank, and the apparatus includes guide members spaced apart along the processing path and located for engaging the baskets to maintain the baskets in alignment as the baskets are indexed along the processing path, and in registration with corresponding processing tanks at the processing stations.

7. The apparatus of claim 6 including further guide members located along the processing path for engaging the bottom of each tray to militate against unwanted tipping of the baskets as the baskets are indexed along the processing path.

8. The apparatus of claim 1 wherein at least one support includes a cover configured for closing the upper opening of the interior of a corresponding processing tank upon movement of the one support into the second location.

9. The apparatus of claim 8 wherein the at least one support further includes a seal for sealing the upper opening of the interior of the corresponding processing tank when the one support is in the second location.

10. The apparatus of claim 1 including a truss-like construct for maintaining the cantilever member in the horizontal orientation.

11. A method for use in processing articles sequentially, along a processing path, the method comprising:

arranging a plurality of processing stations serially along the processing path, with each processing station including a processing tank having an interior extending vertically downwardly from an upper opening for receiving articles delivered into the interior of a corresponding processing tank through the upper opening;

providing a plurality of article holders for carrying the articles along the processing path, from one processing station to a next-consecutive processing station;

indexing the article holders along the processing path, from one processing station to a next-consecutive processing station;

providing an individual overhead support arrangement located at each processing station for receiving each one of the article holders, in sequence, with each article holder suspended from a corresponding support placed at a first location outside the interior of a corresponding processing tank, vertically above the upper opening of the corresponding processing tank; and providing a plurality of selectively actuated individual actuators and coupling each actuator to a corresponding support for selectively moving each support, in response to selective actuation of a corresponding coupled actuator, in a vertical direction between the first location outside the interior of the corresponding processing tank, wherein the selectively moved support is in position to receive a corresponding article holder suspended below the selectively moved support, and a second location outside the interior of the corresponding processing tank and below the first location, wherein the corresponding article holder is placed within the interior of the corresponding processing tank, while the selectively moved support remains outside the interior of the corresponding processing tank;

whereby the articles are placed sequentially into the interior of each processing tank, while each support remains overhead, outside the interior of each processing tank, during a processing operation.

12. The method of claim 11 including uncoupling an article holder from one support and coupling the uncoupled article holder to a next-consecutive support upon indexing the article holder from the one support to the next-consecutive support.

13. The method of claim 12 including:

constructing each article holder in the form of a basket for carrying the articles, each basket including a tray having a side and a bottom;

providing a basket frame extending vertically upwardly from the tray; and coupling each basket frame with a corresponding support such that each basket is suspended from the corresponding support.

14. The method of claim 13 including providing the interior of each processing tank with an essentially rectangular horizontal cross-sectional configuration, providing each basket with an essentially rectangular horizontal cross-sectional configuration generally complementary to the horizontal cross-sectional configuration of each processing tank, locating guide members spaced apart along the processing path, and engaging the baskets with the guide members to maintain the baskets in alignment as the baskets are indexed along the processing path and registered with corresponding processing tanks at each processing station.

15. The method of claim 14 including locating further guide members along the processing path, and engaging the bottom of each tray with corresponding further guide members to militate against unwanted tipping of the baskets as the baskets are indexed along the processing path.

16. The method of claim 11 including providing a cover for closing the upper opening of the interior of a corresponding processing tank upon movement of a corresponding support into the second location.

17. The method of claim 16 including providing a seal for sealing the upper opening of the interior of the corresponding processing tank when the corresponding support is in the second location.

18. The method of claim 11 including oscillating a support placed at a selected processing station, the oscillation being between the first and second locations of the support and having an amplitude such that the articles being processed at the selected processing station are moved into and out of a bath held in the interior of a corresponding processing tank placed at the selected processing station during the processing operation.

* * * * *